US006247403B1

(12) United States Patent
Randazzo

(10) Patent No.: US 6,247,403 B1
(45) Date of Patent: Jun. 19, 2001

(54) SHOCK ABSORBER CUSHION FOR FLEXOGRAPHIC PRINTING PLATE AND METHOD OF USE

(76) Inventor: Jeffrey A. Randazzo, 7211 Pimlico La., Parkland, FL (US) 33076

( * ) Notice: Subject to any disclaimer, the term of this patent is extended or adjusted under 35 U.S.C. 154(b) by 0 days.

(21) Appl. No.: 09/334,847

(22) Filed: Jun. 16, 1999

(51) Int. Cl.[7] ..... B41F 27/00; B41N 1/00; B41N 10/00; B41B 1/02; B41L 38/00

(52) U.S. Cl. ..... 101/379; 101/395; 101/401; 100/211

(58) Field of Search ..... 101/368, 372, 101/375, 376, 401, 401.3, 401.1, 395, 377, 379, 380, 381; 492/30, 33, 56; 428/909; 100/160, 163 R, 164, 165, 162 B, 169, 211, 295, 296

(56) References Cited

U.S. PATENT DOCUMENTS 3,425,347 * 2/1969 Nard ..... 101/376
3,599,306 * 8/1971 Brafford ..... 29/132
3,903,794 * 9/1975 Grupe et al. ..... 101/376
4,375,971 * 3/1983 Moll ..... 493/442
4,685,393 * 8/1987 Saueressig ..... 101/375
5,553,806 * 9/1996 Lucas ..... 242/542.4
5,704,291 * 1/1998 Lewis ..... 101/457
5,752,444 * 5/1998 Lorig ..... 101/375
5,894,799 * 4/1999 Bart et al. ..... 101/376

* cited by examiner

*Primary Examiner*—Kimberly Asher
(74) *Attorney, Agent, or Firm*—Malin, Haley & DiMaggio, P.A.

(57) ABSTRACT

A sheet of elastomeric material that serves as a shock absorber and cushion for use between a flexographic printing plate and a printing cylinder during printing for compensating for variations in thickness, height and centricity of the printing cylinder and flexographic printing plate to prevent distortions in the image being printed that includes providing an elastomeric sheet having a longitudinal direction in the direction of circumferential travel of the cylinder circumference that includes a plurality or array of protrusions formed of the elastomeric material of predetermined cross-sectional shape and area and the material having a durometer to cushion the flexographic plate in such a way to provide the necessary compensation to ensure a high quality printed image at high speed. The cross-sectional shapes and the array of the longitudinal protrusions provide for material displacement zones that allows the elastomeric material to be compressed and return relatively instantaneously to its original height or near original height in sharing high quality printing compensating for tolerance errors between the drum size and the flexographic plate thicknesses.

16 Claims, 5 Drawing Sheets

SHOCK ABSORBER CUSHION FOR FLEXOGRAPHIC PRINTING PLATE AND METHOD OF USE

BACKGROUND OF THE INVENTION

1. Field of the Invention

This invention relates to a shock absorber and cushion for use between a flexographic printing plate and a printing cylinder during printing that compensates for variations in thickness, height and centricity of the materials and equipment used for printing to enhance the image quality and efficiency of the flexographic printing process without increasing printing pressure.

2. Description of Prior Art

Flexography is a printing process used primarily in the packaging and newspaper industries. The flexographic process requires that a raised surface plate be used to transfer ink onto a given substrate. This is unlike lithography, which works on a flat plane based on the principle that oil and water do not mix. The gravure printing process is a recess process in which cells are engraved into the print cylinder that are then filled with ink and then transferred to the substrate.

The flexographic printing process' unique capabilities include changing cylinder dimension (circumference) to accommodate As in most manufacturing and machine processes, there is a plus or minus tolerance in gauge (thickness) uniformity which may include: the print cylinder uniformity, both across and around the web; a tolerance in the material surface being printing on; and, the tolerance of the back cylinder which the substrate rides on as it maneuvers through the press in addition to other mechanical elements. Variations in tolerances require excessive pressure during printing on the flexographic plate to overcome inaccuracies which may smear and distort the print image such as halos and oval dots.

Currently the raised imaged carriers (flexographic plates) adhere to a print cylinder using various methods which include clamps, pins, vacuum and most commonly, an adhesive tape applied to a flat seamless cylinder. There are various types of adhesive tapes used to adhere the flexographic printing plate to the cylinder. Although there are many variations of adhesive tape materials available, the materials used are routinely lumped into the following three categories:

(1) Hard Tape—no significant or claimed cushioning affect. This tape is best used when large amounts of ink need to be applied at 100% strength (full strength). However, since this tape has no inherent ability to even out the mechanical tolerances of the printing press, more than minimal pressure is normally required. This pressure creates a distorted printed image appearing in various forms which may include hard edges around the outer portion of the line copy while leaving a halo adjacent to this hard edge. Depending upon impression required, text may be squeezed to a point where it begins to slur (elongated the print in a through-press direction).

(2) Soft Tape—used as a cushion to allow even impression across and around the cylinder. This is because soft foam tape collapses or compresses under pressure in the areas that come into impression first which represent the largest circumference of the print package and must be impressed several thousands more until the entire image appears to be printing evenly and uniformly. Because of its softness, this material is used primarily when fine details or extremely small images are printed to help minimize the distortion that occurs under pressure with hard tape. Soft tape is traditionally used when printing half tones for screened pictorials, gradations and screen tints. Due to the soft nature of this cushioning element, the amount of pressure required to transfer a solid image is significantly compromised.

(3) Medium tape used as a cushioning element considered to be of medium density. Medium tape is a compromise between the attributes of a soft tape used for printing fine graphics, and, hard tape used for images which need to print robust solids on the same printing surface using the same cushioning material.

The present invention eliminates or minimizes the negative attributes of the tape product(s) described above available today. This includes inconsistency in gauge of the raw material currently available which is said to vary by plus or minus several thousands of an inch. With foam technology, foam cells or voids are filled with air, and during impression, under high spots, air is forced away and needs time to return to cells and thus return to initial tape height or dimension prior to the next revolution of the press. Cell inflation delay requires the press to run at lower speeds when working with a softer foam tape, soft or medium. The slower drum speeds provide the time for the foam cell tape material to rebound between successive impressions. Throughout a very long print run, the adhesive tape material gradually loses ability to rebound. Constant monitoring is required throughout the run and most often results in color shifts and unacceptable print at some point in time, which is normally over one million impressions—but in most cases not greater than three million impressions.

U.S. Pat. No. 3,285,799 discloses a printing blanket for long periods of use in offset lithography which is composed of a polymeric film and woven backing, an ink transfer layer, and a resilient compressible support layer. The support layer has an external surface subdivided by grooves which leaves flat surfaced islands. The blanket is used as an intermediate to transfer an ink image from a printing plate to paper. The support layer has a durometer of at least 60 Shore A. The support layer contains at least about 0.005 cubic inches of voids per square inch of blanket surface but total void volume does not exceed 40%.

U.S. Pat. No. 5,325,776 discloses a cushioning backing sheet metal material positioned between a flexographic printing cylinder and a flexible printing plate. The cushioning sheet is an elastomeric material containing widely spaced, closed cell voids which provide pockets within which the encapsulated air can be pneumatically compressed when force is applied, and which all rebound rapidly when the force is relieved. A disadvantage of the closed-cell cushioning material fatigues and looses compression and resilience qualities, and thus print quality deteriorates.

BRIEF SUMMARY OF THE INVENTION

A shock absorber and cushion for use directly or indirectly under a flexographic printing plate in order to compensate for variations in thickness, height and centricity of the printing cylinder and flexographic plate during the printing process. The invention includes a sheet of elastomeric material sized to be placed around the printing plate cylinder, said elastomeric sheet having predisposed displacement zones resulting from creating voids within the elastomeric material of predetermined thicknesses of the material sheet providing a path of least resistance for the displacement material for maintaining an even impression along the flexographic plate both across and around the printing plate cylinder.

The sheet of elastomeric material includes a predetermined geometric pattern that define the displacement zones which are essentially circumferential in direction, i.e. linear raised protrusions that extend in the direction of the printing path and that can be in parallel rows, spaced apart, circumferentially around the printing cylinder and in the direction of the printing drum rotation. The elastomeric sheet in accordance with the present invention has a plurality or an array of spaced-apart zone displacements of a predetermined geometrical cross-sectional shape and size which are preferably in a parallel array in the direction of the rotation of the printing cylinder (substantially circumferential) relative to the printing cylinder. The spaced apart displacement zones allow the elastomeric material to be radially displaced to accommodate variations in thickness, height and centricity of both the flexographic plate and the print cylinder to which it is mounted.

The linearity of the protrusions could vary somewhat perhaps to around 45°. The geometric pattern is designed to deliver varying amounts and levels of displacement or compression resistance thus controlling the impression required for fine graphics and the resilience necessary to print large solids. By way of example, most, if not all, geometric shapes in view will provide the necessary displacement zone. The displacement zone is a combined product of the geometric cross-sectional area and shape itself and is greatly influenced by the distance placed between these protrusion elements as well as the durometer of the elastomeric material.

It is important that any geometric shape run (with or without break) in-press direction around the print cylinder. The press direction is described as the direction the printed material travels through the press. The importance of putting this geometric shape in-press direction creates the path of most resistance for displacement around the cylinder forcing the displacement across the cylinder in such a way as to not distort the printed image.

The cushioning element is compromised of two layers: one is the base layer which consists of any metallic or polymeric film material which is dimensionally stable; or, MYLAR that is no less than 0.002 in thickness and without a limit to maximum thickness. This material is used as a stabilizing base for the second layer which contains the geometric protrusion array made of elastomeric material of a predetermined durometer whose resilience at normal operating temperatures will deform and fill the adjacent displacement areas under various amounts of stress. The cross-sectional shape of each protrusion strip may be a trapezoid by way of example. The strips are parallel spaced apart at a predetermined distance and across the cylinder width. Suitable elastomeric materials include, but are not limited to, polybutadience, polyisoprene, polychloroprene; and olefin copolymers such as styrene-butadiene copolymers, nitrile rubbers (e.g. acrylonitrile-butadiene copolymer), ethylene-propylene copolymer, and butyl rubber (e.g., isobutylene-isoprene copolymer). Elastomers which are thermoplastic are also suitable as the cushion layer and include, but are not limited to, styrenediene-stryene triblock copolymers, such as polystyrenepolybutadiene-polystyrene (SBS), polystyrene-polyisoprene-polystyrene (SIS, or polystyrene-poly (ethylenebutylene)polystyrene (SEBS); thermoplastic polyester and polyurethane elastomers; and thermoplastic polyolefin rubbers (polyolefin blends). Suitable elastomers also include chlorosulfonated polyethylene, polysulfide, polyalkylene oxides, polyphosphazenes, elastomeric polymers and copolymers of acrylates and methacrylates, and elastomeric copolymers of vinyl acetate and its partially hydrogenated derivatives.

In an alternate embodiment, the layer of elastomeric material can also be compromised of multiple layers with different Shore A hardness. Each circumferential protrusion could be made of two or more layers of materials of different durometers to further efficiently control the resistance. The required resistance may vary and be altered to respond to the various print market such as corrugated, news print, poly/plastic sheets and paper which may require different rsistances. Being able to control these individual factors, a wide range of refinements for various cushioning requirements are possible. These protrusions from top to base formed from the elastomeric material should be greater than 10% of the total volume from floor to ceiling and should not exceed 80%. The most preferable ratio is between 15% and 50% volume of material to displacement void. The area adjacent the protrusion material mass shall be considered displacement void zones. The embodiment of this displaceable protrusion material is currently created by using photopolymer plate material from various manufacturers including but not limited to DuPont's "Cyrel®", Polyfiberons' "Epic®" and BASF's "NyloFlex®" photopolymerizable, photocrosslinkable or both. The photopolymerizable layer compromises an elastomeric binder, at least one monomer and an initiator, where the initiator is preferably a photoinitiator having sensitivity to actinic radiation. Any photopolymerizable compositions which are suitable for the formation of flexographic printing plates can be used for the present invention. Examples of suitable compositions have been disclosed, for example, in Chen et al, U.S. Pat. No. 4,323,637, Gruetzmacher et al, U.S. Pat. No. 4,427,749 and Feinbert et al., U.S. Pat. No. 4,894,315.

The processes available to manufacture the cushion include laser engraving, mechanical engraving, molding vulcanized rubber, extruding and other current technologies.

The cushion is mounted between the plate cylinder surface and the flexographic plate base. The cushion may be glued to the cylinder surface and to the flexographic plate surface. Alternatively, sticky tape may be used to attach the cushion with adhesive to the drum cylinder and also to the flexographic plate surface.

The cushion may be mounted so that the protrusions engage the bottom of the flexographic plate or conversely such that the protrusions engage the surface of the plate cylinder. In the preferred embodiment, the protrusions would engage the print cylinder surface and be essentially inverted relative to the flexographic plate surface. Whether upside down or right-side up, depending on the point of view, it is important that the protrusion strips must be disposed to run parallel or in the direction of the circumferential drum rotation. The cushion material could also be used with any other flexographic plate mounting system that may include vacuum, clamps, sleeves, pins or other mechanical attachment.

The cushion, in accordance with the present invention, can be mounted onto the plate cylinder with adhesive, glue or double-sided adhesive tape. Thus, the cushion is directly against the printing plate, or indirectly, if you consider that glue or adhesive tape holds the cushion to the cylinder and to the printing plate.

In alternate embodiments, the cushion and protrusions could be extruded on the back of the flexographic printing plate so that it becomes part of the printing plate itself. In that case, the cushion and plate would be together as one single entity and then would be mounted by adhesive or other fastener onto the print cylinder. It is also in another embodiment possible that the plate cylinder surface itself could include permanently a particular cushion. And yet another possible alternate embodiment would be that the cushion is actually a cylindrical sleeve that is stretched over and placed on the print cylinder surface that can be put on and off as a sleeve.

It is an object of this invention to provide an improved cushion or shock absorber for use in the flexographic printing process to compensate for variations in thickness, height and centricity of the materials and equipment used in flexographic printing to enhance image quality and efficiency without increasing printing pressure which distorts the ultimate printed image.

It is another object of this invention to provide a cushion between a flexographic plate and printing drum that retains its resiliency without fatigue over extremely long printing runs without reducing image quality.

In accordance with these and other objects which will become apparent hereinafter, the instant invention will now be described with particular reference to the accompanying drawings.

PREFERRED EMBODIMENT OF THE INVENTION

Figure 1:
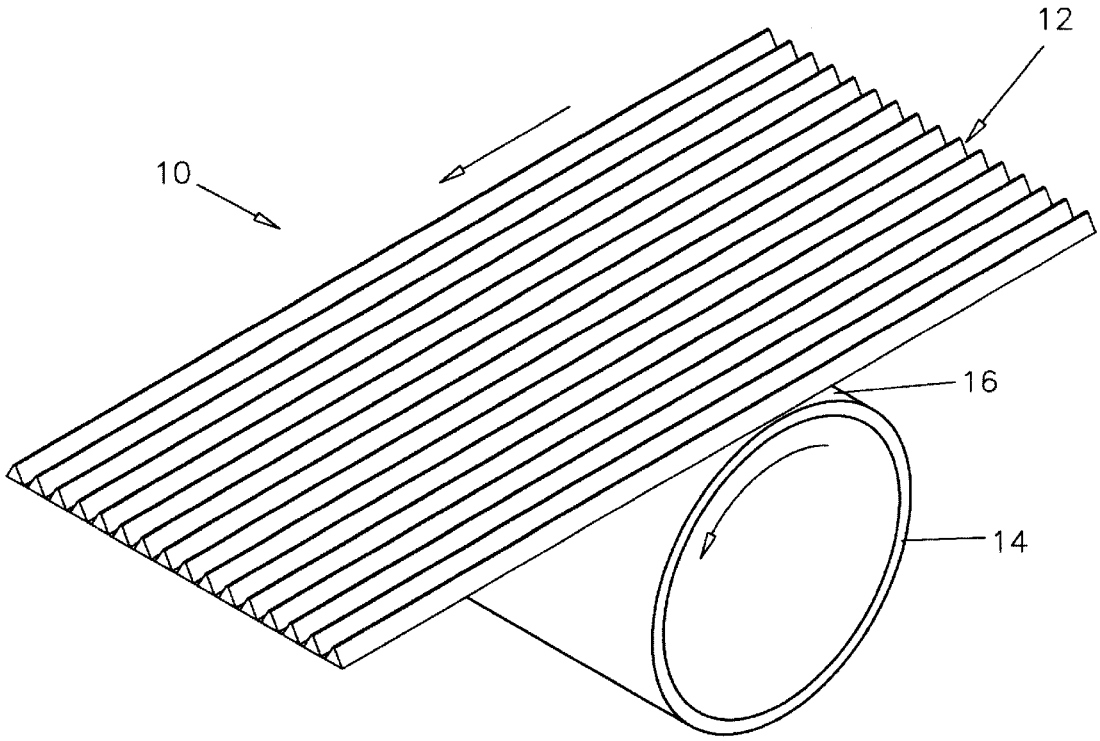
FIG. 1 shows a perspective view of an elastomeric sheet disposed adjacent a plate cylinder in accordance with the present invention. The sheet shown in FIG. 1 is to be wrapped around the outside of the cylinder, which represents the plate cylinder.

Referring now to the drawings, and in particular FIG. 1, the present invention, which is used as a shock absorber or cushion, is shown generally at 10 comprised of a sheet of elastomeric material 12 that is shown positioned above a plate cylinder 14 having a surface 16 that is used with a flexographic plate, (not shown in FIG. 1) for printing. In the operating position, the elastomeric sheet 12 is in fact disposed around the circumference of cylinder 14 and may be glued or otherwise fixed to the cylindrical surface 16 around the drum. A double-sided stickback adhesive sheet can be employed to affix the cushion to the drum. The arrow shows the direction of the drum rotation and also, therefore, the direction of the elastomeric sheet 12 in operation. In the preferred embodiment, the protrusion strips engage the drum surface.

A flexographic printing plate used for printing is affixed (glued) on top of cushion 12. Therefore, the elastomeric sheet 12 acts as a shock absorber or cushion between the drum surface and the flexographic printing plate which is attached by glue on top of the cushion 12.

Once the plate and cushion 12 are installed, the flexographic printing process would then proceed as normal. If the cylinder 14 has tolerance errors in diameter or if the thicknesses of the flexographic plate vary from the ideal norm, the cushion 12 allows for compressive displacement to allow equal pressure on the flexographic plate during its operation of printing so that the final printing does not have flaws (bright/dark spots or slur). Because of the compressive displacement of the cushion 12, excessive printing pressure on the plate is not necessary that would otherwise distort the image forming elements.

Figure 2:
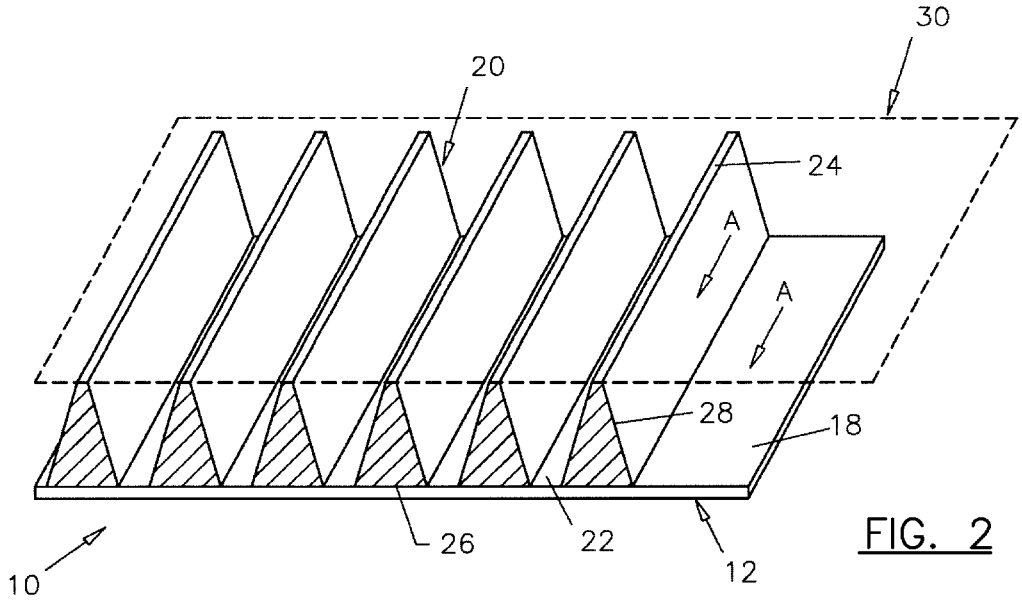
FIG. 2 shows a perspective view, partially in cross-section and cut-away, of a section of the elastomeric sheet shown in FIG. 1.

Referring now to FIG. 2, the elastomeric sheet 12 is shown (partially cut away as a segment) that is comprised of a MYLAR support base 18 that has a plurality of trapezoidally-shaped (in cross-section) photopolymer elastomeric protrusions 20 which are attached to MYLAR sheet 18 and are essentially parallel strips in a parallel array and spaced apart by a predetermined distance as shown by area 22 that separates adjacent protrusions 20.

Each trapezoidally-shaped protrusion 20 includes a small flat top surface 24 that is parallel to the top surface of support base 18, a pair of converging sidewalls 28 that converge to the top wall 24 and a bottom wall 26 affixed to base 18.

The cushion 12 is comprised of a cushion layer of elastomeric material forming protrusions 20 and the MYLAR support base 18. The total volume of material occupied by each protrusion 20 and one adjacent void whose base is shown as surface 22 define a displacement zone which allow for vertical compression or displacement of each protrusion area into adjacent void space between the protrusions. When looking at a cross-section perpendicular to the movement of cushion 12 defined by arrow A along the drum surface, the cross-section across the width of the cushion shows the trapezoidal-shaped faces of the protrusion and a likewise trapezoidally-spaced void between protrusions. The dimensions of each protrusion, including the length of the top, the converging sidewalls, the base 26 and the displacement adjacent space which includes surface 22 and diverging walls between adjacent protrusions and the distance between the tops of adjacent protrusions are selected to meet a predetermined material to displacement zone of 30%–90%. Therefore, the area of the trapezoid forming a protrusion 20 would be approximately 10%–70% the entire area occupied by one trapezoid and one adjacent void area. The cross-sectional shape of each protrusion, perpendicular to the direction of travel, can be varied and is discussed in greater detail below. Also the protrusions are in straight lines, some lateral displacement such as a zigzag or slightly s-shaped strip with deviations less than 450 may be tolerated relative to the straight line direction of travel indicated by arrow A.

The protrusions 20 are formed from a sheet of photopolymer material using known technology and can be of different geometric configurations as discussed below. The displacement necessary to be an effective shock absorber is figured by the pressure where a flexographic plate 30, as it rests on the top wall 24 of each of the protrusions, would be compressed by variations and errors in the centricity of the drum or the variations in the thickness of the flexographic plate 30 during operation or during the printing process itself.

The purpose of the invention is to allow sufficient displacement vertically between the drum and the flexographic plate 30 that the elastomeric material, and in particular the protrusions 20, can be compressed or deformed downwardly and also return to their static position without wear or stress. The shape in cross-section, which would be perpendicular to the direction of arrow A as shown, of each protrusion 20, the specific dimensions of the base, the top, the sidewalls, and the spacing between protrusions along the base and the top wall, are factors in determining the amount of ultimate displacement therefore controlled resistance that occurs between the cylinder 14 and especially the drum surface 16, as shown in FIG. 1, and a flexographic plate 30, as shown in FIG. 2. It is important that the protrusions 20 have a longitudinal access in the direction of arrow A, which is also the circumferential direction of the drum movement during the printing operation. Under low stress at room temperature, the elastomeric protrusions will return to its original or near original height or gauge for extended printing runs.

Figure 3:
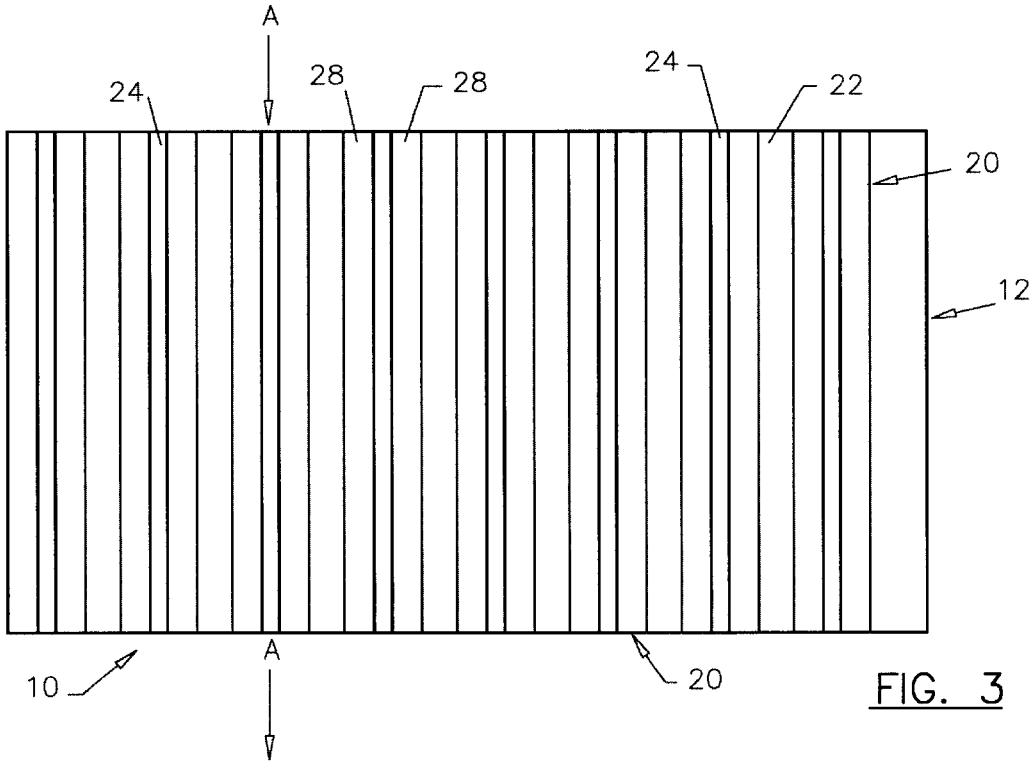
FIG. 3 shows a top plan view of the segment shown in FIG. 2.

FIG. 3 shows a top plan view of the elastomeric sheet 12 and the spacing 22 between adjacent protrusions 20. Also shown in FIG. 3 is the width of the top wall of protrusion 20 and how they are parallel to each other and spaced uniformly in strips across the entire width of cushion 12. Arrow A represents the direction of travel so that the cushion 12, as shown in FIG. 3, would actually be wrapped around the drum with the protrusions 20 oriented in the direction of rotation of the drum circumferentially and in the direction of arrow A. Therefore, the width of the sheet 12 would constitute and be determined by the width of the drum itself. The printing drums do vary in size and width and in diameter, and the cushion would be manufactured in sufficient lengths and widths to accommodate drums of different diameters and widths. Also the spacing 22 between each protrusion helps define the total displacement area available.

FIG. 4, again, shows the relationship between protrusions 20, which are in an adjacent parallel array. Each protrusion 20 includes a flat top wall 24, a base 26 longer than the top 24 and the spacing 22 along the entire sheet base 18. In operation a flexographic plate 30 is glued to the MYLAR support base 18 and the drum surface is glued against each of the top walls 24 of all of the protrusions 20. The sheet 12 may be inverted in operation such that the mylar base 18 is glued against the drum surface.

Figure 4:
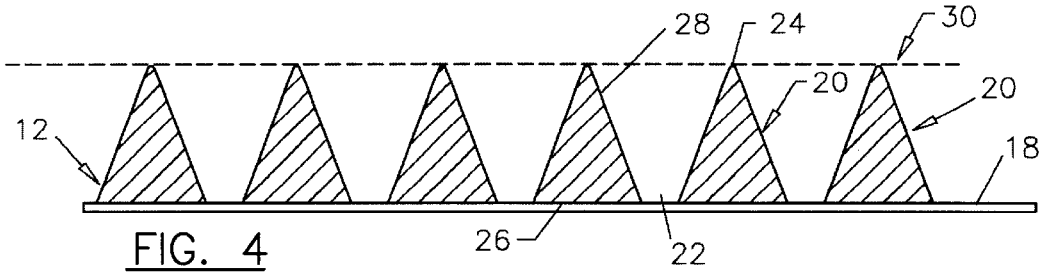
FIG. 4 shows a cross-sectional view schematically of the elastomeric sheet shown in FIGS. 2 and 3.
Figure 5:
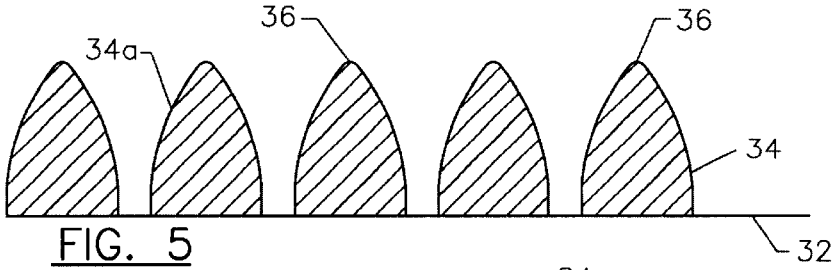
FIG. 5 shows an elevational cross-sectional view of an alternate embodiment of the present invention showing different elements of the geometric shape as well as adjacent displacement areas.

In an alternate embodiment, the cross-sectional shape of the protrusions could be varied to something like shown in FIG. 5, which is a modified trapezoid that includes sidewalls 34 and 34A that converge along the top wall 36. Again, a flexographic plate 30, such as shown in FIG. 4, could rest along the top wall surfaces 36 in each of these protrusions so that displacement would be a downward compression between the flexographic plate 30 and a drum that would be along the bottom surface of 32 or the cushion could be inverted as discussed above.

Print cylinders vary in both width and circumference. The circumferential range of print cylinders are available in circumferences from less than 6 inches to over 40 inches. Dimensions of print cylinders change circumferentially based on the package repeat or length. Flexography uses a raised plate of varying thickness, ranging from 0.03 inches or less to greater than 0.155 inches. In the prior art, the adhesive/foam tape that was available came in different thicknesses and when the print cylinder or sleeves are ordered, the overall height of elements adhere to the cylinder plate or attached by a sleeve must be a known and consistent overall height. The tolerance for this variation is known as "cylinder undercut". One of the purposes of this invention is to provide an overall buildup of elements adhered to a print cylinder that add up exactly toward the proper undercut. Therefore, if in an example, a plate were 0.067 inches and the blanket were 0.020 inches, the undercut would be 0.087 inches. With the present invention, the plate would be 0.045 inches and an adhesive plate to blanket would be 0.002 inches while the blanket itself would be 0.030 inches and the adhesive blanket to the cylinder would be 0.010 inches. This would result in an undercut of 0.087 inches.

In accordance with this invention, there is a direct relationship between the elastomeric material durometer, the shape of the protrusion or displaced element, the materials height, shape and area of displacement. All tests to-date have involved wide-web presses thirty (30) inches and wider printing on a plastic polymer. A change in protrusion height, geometric shape of the elements, the durometer of the displacement material in addition to changes in the displacement zone may require further modifications which could be determined by each market segment, namely the print medium to be used in the printing process.

EXAMPLE

The characteristics in accordance with this invention were tested with displacement projections that were in straight line ranging in widths of 0.001 inches to approximately 0.3 inches. The second characteristic of the pattern used is the spacing between images. The present invention in experiment realized various levels that were successful when the void space was at least equal to the materials' surface image with spaces as great as ten times the image width. In accordance with this example, the most preferable image top width was 0.004 inches while maintaining a space between images of 0.042 inches. This creates an image support that, at its most narrow point, was 0.004 inches in expanding in width from the top of the blanket to the mylar base approximately 0.021 inches.

It is important that regardless of the geometrical cross-sectional shape that the protrusion element run essentially circumferentially, preferably without a break in the circumferential direction around the print cylinder, that is the press direction. The press direction is described as the direction the printed material travels through the press. The importance of putting this geometrical shape in the press direction creates the path of most resistance for displacement around the cylinder, forcing the displacement across the cylinder in such a way as to not distort the printed image. Small breaks (not full depth) in the protrusion strip element in the circumferential direction may be permitted for a specific configuration.

Figure 6:
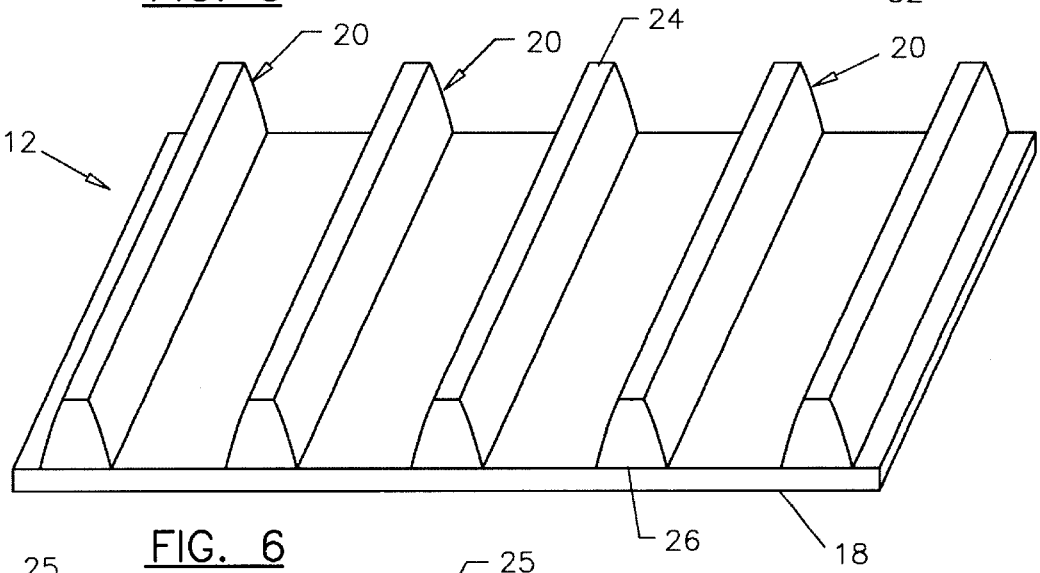
FIG. 6 shows a prospective view of one embodiment of the invention.

Referring to FIG. 6, the cushion or shock absorber 12 is comprised of two layers. The first layer 18 is a dimensionally stable support base layer of MYLAR, metal, fabric, composite, or alternate flexible material or polymeric film material, which is dimensionally stable or MYLAR that is no less than 0.002 inches in thickness and without a limit to maximum thickness. The first layer 18 is used as a stabilizing base for the photopolymer second layer 20, which contains the elastomeric material and the plurality in array of circumferential protrusions whose resilience at normal operating temperatures will deform and fill the adjacent displacement areas under various amounts of compression or stress. They elastomeric protrusions return relatively instantly and rapidly to the original or near original dimension when the compression pressure is removed. The second layer 20, which is the elastomeric material, can be comprised of multiple layers with different Shore A hardness.

The protrusions in cross-sectional areas formed from the elastomeric material should be greater than ten percent (10%) of the total cross-sectional area from top 24 to the base 26 and should not exceed seventy percent (70%). The most preferable ratio is between fifteen and fifty percent (10%–70%). The area comprising the rest of the material mass shall be considered displacement zones or voids.

Figure 7:
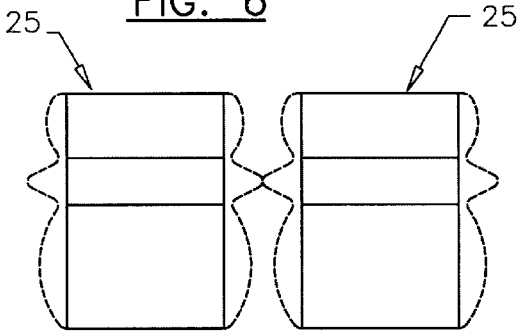
FIG. 7 shows a schematic diagram of an alternate embodiment of the invention using different durometers and different hardness in an elevation in cross-section. The dotted lines represent the compression distortion and resistance when the element is compressed downwardly.

FIG. 7 shows a pair of protrusions 25 as an example that has, from top to bottom, different layers of material of different durometers which would be used to control the effect of cushion resilience. The multi-layers of varying durometer would thus control initial displacement zone and the effective overall cushion resilience. The dotted line show the proposed displacement from a vertical or top down compression caused by tolerance errors in the printing equipment as discussed above. Thus, it can show that each area would have a different displacement, but the sum total would be at some desired total displacement.

Referring now to FIG. 8, a plurality of different cross-sectional representative shapes for the protrusion strips are shown schematically that represent the possible cross-section of the protrusions as they are attached to the MYLAR sheet. The compression displacement expected is shown as dotted lines indicating displacement of adjacent protrusions in operation. In FIG. 8A, rectangles are shown and the dotted portions are shown curved due to downward compression on these elements.

Figure 8A:
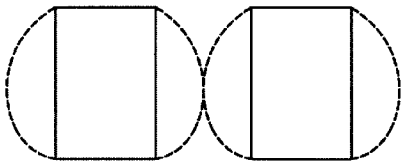
FIGS. 8A through 8M show pairs of cushion elements represented schematically as the cross-sectional shape of adjacent protrusions with the dotted lines representing areas of geometric displacement zone when the elements are compressed downwardly due to variations in the printing process to be corrected.
Figure 8B:
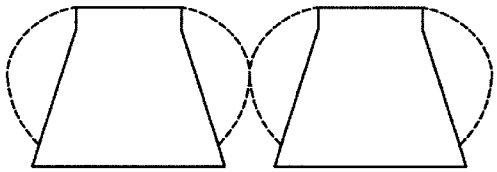

In FIG. 8B, trapezoids are shown that compress (as shown dotted), and they may contact each other.

Figure 8C:
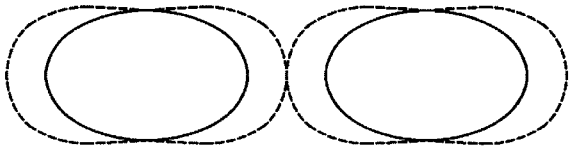

FIG. 8C shows a pair of ovals that can expand sideways (as shown dotted) for the displacement from top down.

Figure 8D:
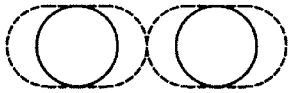

FIG. 8D shows a pair of circular protrusion elements that can expand (as shown dotted).

Figure 8E:
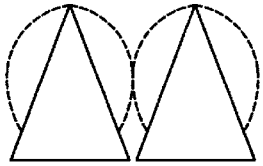

FIG. 8E shows a pair of isosceles triangles spaced apart and the anticipated displacement (as shown dotted).

Figure 8F:
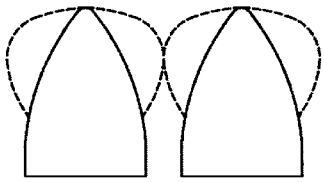

FIG. 8F shows a pair of protrusions having a flat top portion somewhat arcuate sidewalls that can expand (as shown dotted).

Figure 8G:
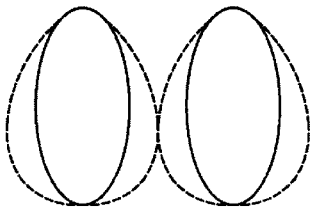

FIG. 8G shows elliptical protrusions or oval shape protrusions with their longer access being vertical and disposed adjacent each other (as shown dotted) showing the displacement.

Figure 8H:
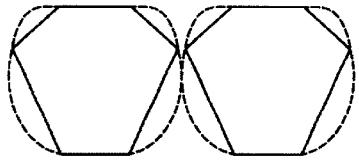

FIG. 8H shows six-sided figures with shorter edges at the top than the bottom, which are polygons, which would be next to each other (as shown dotted).

Figure 8I:
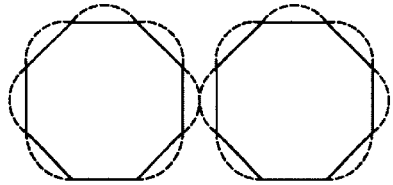

FIG. 8I shows octagons and the resulting displacement as shown dotted.

Figure 8J:
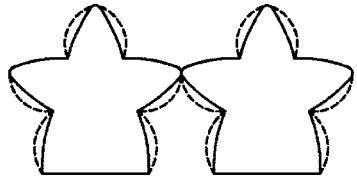

FIG. 8J shows protrusion elements that are star shaped in the top portion and the displacement expected as shown dotted.

Figure 8K:
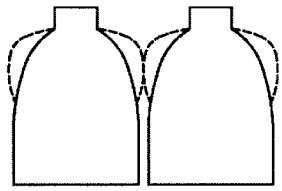

FIG. 8K shows somewhat arcuate protrusions with flat tops on them placed adjacent each other with the dotted lines showing compression displacement.

Figure 8L:
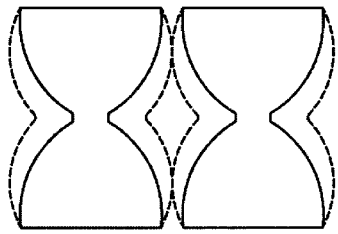

FIG. 8L shows two somewhat circular cross-sectional units joined end-to-end, from top to bottom, and the dotted lines show the anticipated displacement during compression.

Figure 8M:
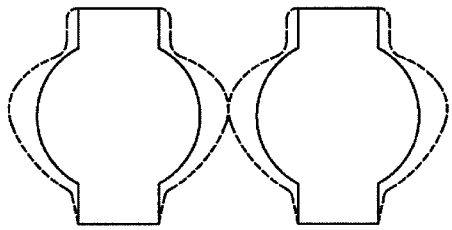

FIG. 8M shows circular center bodies with rectangular tops and bottoms for protrusions, and the dotted lines show the anticipated compression.

Referring back to FIG. 6, the preferred embodiment of the invention is shown to provide specific dimensions such as approximately 0.063 inches from center-to-center of each adjacent protrusion with the base of each protrusion being approximately being 0.021 inches in width at its base, and the spacing between protrusions along the base portion be 0.042 inches. The dimensionally stable carrier 18 is 0.007 inches. The top wall 24 is 0.004 inches approximately.

Figure 9:
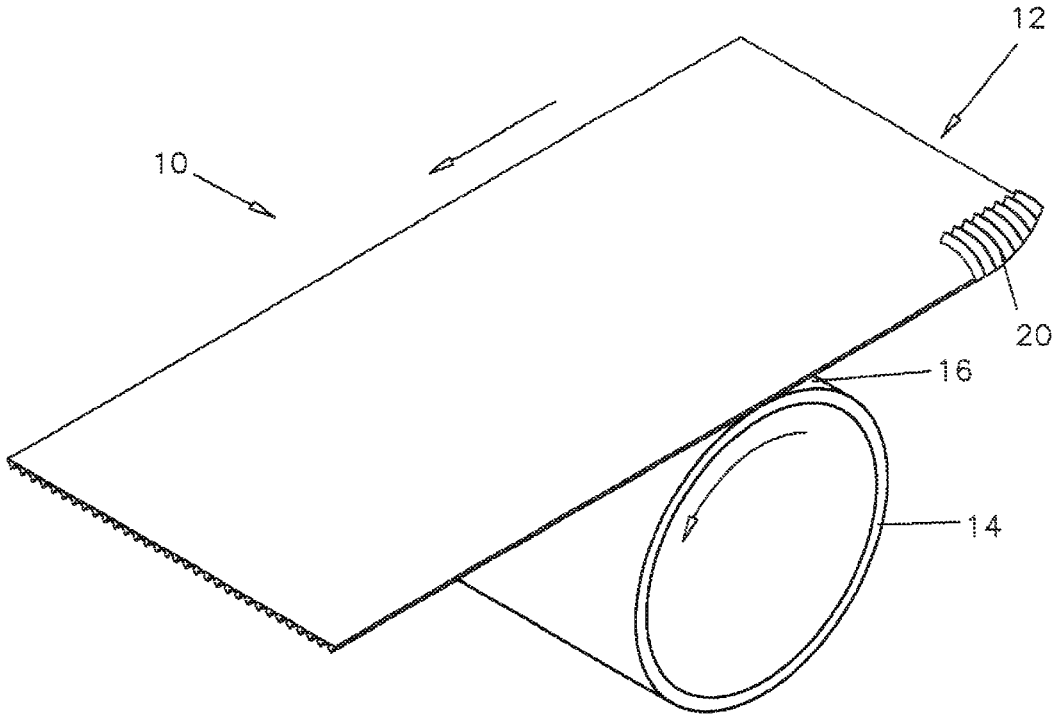
FIG. 9 shows a perspective view of the invention in which the cushion 12 protrusions 20 are face down for attachment to the printing drum cylinder surface 16 with a suitable adhesive.
Figure 10:
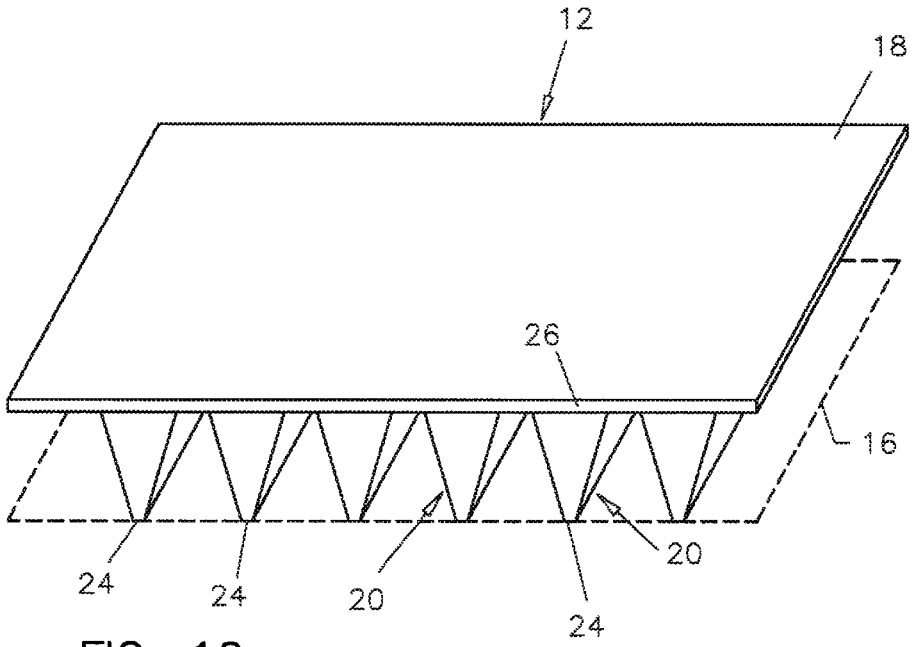
FIG. 10 shows a perspective view of the invention wherein the cushion 12 protrusion tops 24 are attached to the print drum/cylinder surface 16.

FIGS. 9 and 10 show the invention in which (during printing) the cushion 12 is positioned such that the tops 24 of the protrusions are affixed to the print drum/cylinder surface 16 while the support 18 would be glued to the flexographic printing plate 30. The cushion 12 remains the same in all structural respects.

In summary, controlling the displacement longitudinally along the direction of the print drum travel with a continuous, or almost continuous, element in a parallel array has been found to greatly improve the shock-absorbing characteristics between the flexographic plate and the drum to greatly increase the accuracy and clarity of the printed material with longer runs because the material does not have to be replaced as often as the prior tape used for this purpose before. Variations will be possible in the geometric shape, the durometer and geometric configurations to vary the displacement based on a particular type of job and material or print medium required.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A shock absorber for use in flexographic printing between a flexographic printing plate and a plate cylinder surface for compensating for variations in thickness, height, and centricity of the cylinder and flexographic plate, the shock absorber comprising:

an elastomeric body for attachment to the surface of a plate cylinder;

said elastomeric body being made of a predetermined durometer;

said elastomeric body including a support base and a plurality of raised protrusions formed of said elastomeric material;

said protrusions having a predetermined height and cross-sectional shape adapted to be longitudinally disposed in the rotational direction of the plate cylinder and spaced apart a predetermined distance such that a compression between the flexographic printing plate and the plate cylinder surface on said elastomeric body will result in a predetermined displacement of said protrusions to compensate for variations in the plate cylinder and flexographic plate operation to improve printing quality;

each said protrusion being continuous along said support base, and having substantially the same length as said support base, each said protrusion adapted to surround and adapted to be continuous around the plate cylinder in the plate cylinder's rotational direction leaving the path of least resistance lateral to the side of the geometric shape of each protrusion during compression; and said protrusions are disposed such that said support base is exposed between said spaced apart protrusions.

2. The shock absorber as in claim 1, wherein:

said longitudinally disposed protrusions of said elastomeric material constitute displacement zones of a predetermined area and volume adapted to provide desired resilient response to pressure applied between said plate cylinder and said flexographic plate on said elastomeric body.

3. A shock absorber as in claim 1, wherein:

said elastomeric body includes a controlled displaceable plurality of protrusions that includes an open displacement cross-sectional area in excess of 30 to 90 percent.

4. The shock absorber as in claim 1, wherein each said protrusion comprises:

a substantially flat top surface substantially parallel to the top surface of said support base;

a pair of tapered sidewalls converging at said top surface; and a bottom surface.

5. The shock absorber in claim 4, wherein said top surface of each said protrusion is adapted to engage said plate cylinder surface and said support base is adapted to engage said printing plate.

6. The shock absorber of claim 4, wherein said top surface of each said protrusion is adapted to engage said printing plate and said support base is adapted to engage said plate cylinder.

7. The shock absorber in claim 1, wherein said plurality of protrusions may contain one or more predetermined breaks.

8. The shock absorber in claim 1, wherein each said protrusion is disposed in a parallel relationship with each other said protrusion.

9. The shock absorber in claim 1, wherein said protrusions are disposed in a random, non-linear manner along said support base provided said protrusions still maintain their longitudinal orientation with respect to the rotational direction of said plate cylinder.

10. The shock absorber in claim 1, wherein said support base is comprised of a MYLAR film having a thickness of at least 0.002 inches.

11. The shock absorber in claim 1, wherein said support base is comprised of any metallic or polymeric film material.

12. The shock absorber in claim 1, wherein said protrusions are comprised of a plurality of layered materials, each of a different durometer.

13. The shock absorber of claim 1, wherein said protrusions are photographically imaged from a solid sheet of material and subsequently processed thereby separating the unexposed material from the exposed material leaving said protrusions having a desired geometric shape.

14. The shock absorber of claim 1, wherein said shock absorber is adapted to be extruded on the back of said flexographic printing plate so that said shock absorber becomes part of said printing plate.

15. A method of enhancing the image quality and efficiency of a flexographic printing process without increasing printing pressure comprising the steps of:

providing an elastomeric body for attachment to the surface of a plate cylinder, said elastomeric body being made of a predetermined durometer, said elastomeric body including a support base and a plurality of raised protrusions formed of said elastomeric material, said protrusions having a predetermined height and cross-sectional shape adapted to be longitudinally disposed in the rotational direction of the plate cylinder and spaced apart a predetermined distance such that a compression between a flexographic printing plate and the plate cylinder surface on said elastomeric body will result in a predetermined displacement of said protrusions to compensate for variations in the plate cylinder and flexographic plate operation to improve printing quality, each said protrusion being continuous along said support base, and having substantially the same length as said support base, each said protrusion adapted to surround and adapted to be continuous around the plate cylinder in the plate cylinder's rotational direction leaving the path of least resistance lateral to the side of the geometric shape of each protrusion during compression, said protrusions are disposed such that said support base is exposed between said spaced apart protrusions.

16. A shock absorber for use in flexographic printing between a flexographic printing plate and a plate cylinder surface for compensating for variations in thickness, height, and centricity of the cylinder and flexographic plate, said shock absorber comprising:

an elastomeric body for attachment to the surface of a plate cylinder;

said elastomeric body being made of a predetermined durometer; and said elastomeric body including a support base and a plurality of raised protrusions formed of said elastomeric material, said protrusions having a predetermined length, height and cross-sectional shape and each said protrusion being continuous along said support base and having substantially the same length as said support base, each said protrusion adapted to surround and adapted to be longitudinally disposed in the rotational direction of the plate cylinder and spaced apart a predetermined distance such that a compression between the flexographic printing plate and the plate cylinder surface on said elastomeric body will result in a predetermined displacement of said protrusions to compensate for variations in the plate cylinder and flexographic plate operation to improve printing quality.

* * * * *